US007303516B2

(12) United States Patent
Petersen

(10) Patent No.: US 7,303,516 B2
(45) Date of Patent: Dec. 4, 2007

(54) LOWER BODY SUPPORT DEVICE

(76) Inventor: Scott J. Petersen, 1325 Abington Way, Mechanicsburg, PA (US) 17050

( * ) Notice: Subject to any disclaimer, the term of this patent is extended or adjusted under 35 U.S.C. 154(b) by 47 days.

(21) Appl. No.: 11/343,427

(22) Filed: Jan. 30, 2006

(65) Prior Publication Data

US 2007/0179032 A1 Aug. 2, 2007

(51) Int. Cl.
*A63B 26/00* (2006.01)

(52) U.S. Cl. ..... 482/142; 482/907; 482/79

(58) Field of Classification Search ..... 482/92–93, 482/142, 79–80, 907; D21/676, 686, 690
See application file for complete search history.

(56) References Cited

U.S. PATENT DOCUMENTS

| | | | | |
|---|---|---|---|---|
| 1,296,522 | A | 3/1919 | Holsey | |
| 1,382,883 | A | 6/1921 | Ashbridge | |
| 1,547,166 | A | 7/1925 | Davidson | |
| 2,627,301 | A | 2/1953 | Emmett | |
| 4,377,309 | A | 3/1983 | Mengshoel | |
| 4,772,071 | A * | 9/1988 | Richards | 297/423.12 |
| 5,073,986 | A | 12/1991 | Farrago | |
| D353,702 | S | 12/1994 | Martinez | |
| 5,537,689 | A | 7/1996 | Dancyger | |
| 5,725,224 | A * | 3/1998 | Kerr | 280/11.19 |
| 5,865,507 | A | 2/1999 | Earl, Jr. | |
| 5,870,774 | A * | 2/1999 | Legenstein | 2/24 |
| 6,302,413 | B1 | 10/2001 | Comeaux | |
| 6,427,239 | B1 | 8/2002 | Worden | |
| 6,637,034 | B1 | 10/2003 | Worden | |
| 6,824,149 | B1 | 11/2004 | Whitlock | |

OTHER PUBLICATIONS

Gundlach Catalog #126, Beno J. Gundlach Company Belleve Illinois, 62222, 2004, p. 28-9.
Orcon Tile Installation Tools Product Catalog, 1570 Atlantic St., Union City, CA 94587,2005, p. 11.
Grain Tools, Catalog 2005, 1155 Wrigley Way, Milpitas, CA 95035, 2005, p. 32.

* cited by examiner

*Primary Examiner*—Lori Amerson
(74) *Attorney, Agent, or Firm*—Kollas and Kennedy; James W. Kollas, Esq.

(57) ABSTRACT

A lower body support device is shown herein. The lower leg of the user is positioned such that the knee of the user rests within the area defined by a knee frame, the shin of the user rests within the area defined by a bend frame, and the ankle of the use rests in the region of an ankle frame. A strap bar means connected to the knee frame allows for the securing of a knee pad, such knee pad is user chosen, worn by the user and strapped to the knee frame via the strap bar means. A seat insert is secured to the top of the ankle frame. The user wears one leg support device on each leg. While resting on a surface, the bottom of the knee frame and the bottom of the ankle frame, and possibly the knee pad worn by the user, contact said surface. Preferably, the buttocks of the user rests on the seat insert, which transfers a significant portion of the weight of the user to the surface via the frames. The ankle frame and knee frame greatly limit the possibility of side-to-side motion. Additionally, the user may stand and walk while employing the leg support device.

10 Claims, 9 Drawing Sheets

LOWER BODY SUPPORT DEVICE

CROSS-REFERENCE TO RELATED APPLICATIONS

Not applicable

STATEMENT REGARDING FEDERALLY SPONSORED RESEARCH OR DEVELOPMENT

Not applicable.

BACKGROUND

1. Field of the Invention

This invention is directed toward the field of lower body support devices. More particularly, this invention relates to a lower body support device for providing improved support, stability, and mobility for users of the device.

2. Discussion of Prior Art

Many occupations require workers to assume kneeling positions in order to attend the task for which they are employed. Unfortunately, assuming a kneeling position for an extended period, or repeatedly, causes those in such a position discomfort, cramping, muscle fatigue, or other similar problems.

Many devices have been proposed over the years to alleviate the discomforts associated with kneeling positions. For instance, U.S. Pat. No. 1,296,522 to Holsey shows a simple knee pad device. Similarly, U.S. Pat. No. 1,547,166 to Davidison shows a slightly more sophisticated knee pad. However, neither device provides much in the way of actual support or cushioning. That is, even though the knee is elevated above whatever surface on which the knee pad rests, the user's weight still stresses the knee.

In U.S. Pat. No. 2,627,301 to Emmett, a knee board is shown. Although this device implements a recognizable pad to cushion the knee, it does not allow much mobility to a standing user. As such, is utility its diminished.

In U.S. Pat. No. 4,377,309 to Mengshoel another knee board device is illustrated. Through a variety of configurations, Mengshoel discloses a more portable device than previously shown. Additionally, the device has provision for a seat element, which takes some stress off the user's knees. However, the user's weight still passes through the user's ankles. Moreover, in the J-shaped ankle configuration the user's leg may separate from the pad, especially when employed in a dynamic occupational setting. Additionally, the O-shaped ankle configuration, the ability of the user to equip the device is impaired. That is, putting one's foot through the O-shaped ankle configuration is difficult.

In U.S. Pat. No. 4,772,071 to Richards, a complicated knee pad device is shown. Said device includes a frame with a knee pad section, a seat section, and a mid-shin floor engaging member. This device is hampered by its obvious complexity. Moreover, it is designed with an integrated knee pad, limiting the user to employing that knee pad exclusively. Additionally, this device is not particularly stable, being prone to side-to-side rolling.

In U.S. Pat. No. 5,865,507 to Earl, a kneeler is shown. This kneeler allows a certain amount of the user's weight to pass through the seat incorporated in the frame of the device. However, a user of the device cannot walk around with this device attached to their legs. As such, the user would have to carry such device with them, greatly diminishing its utility.

As such, there is a void in the prior art in the field of lower body support devices. The prior art lacks a device which provides improved lower body support, mobility, and stability in a less complex configuration. The present invention fills this void.

BRIEF SUMMARY OF THE INVENTION

In accordance with the present invention, a lower body support device is shown herein. The lower leg of the user is positioned such that the knee of the user rests within the area defined by a knee frame, the shin of the user rests within the area defined by a bend frame, and the ankle of the use rests in the region of an ankle frame. A strap bar means connected to the knee frame allows for the securing of a knee pad, such knee pad is user chosen, worn by the user and strapped to the knee frame via the strap bar means. A seat insert is secured to the top of the ankle frame. The user wears one leg support device on each leg.

While resting on a surface, the bottom of the knee frame and the bottom of the ankle frame, and possibly the knee pad worn by the user, contact said surface. Preferably, the buttocks of the user rests on the seat insert, which transfers a significant portion of the weight of the user to the surface via the frames. The ankle frame and knee frame greatly limit the possibility of side-to-side motion. Additionally, the user may stand and walk while employing the leg support device.

OBJECT AND ADVANTAGES

Accordingly, the objects and advantages of the invention are:

A) to provide a lower body support device which allows the user to choose a knee pad to fit within the knee frame of the device, whereby such knee pad may be any of several available on the open market;

B) to provide a lower body support device which may be worn and employed by a user while kneeling, standing, or walking;

C) to provide a lower body support device which transfers a significant portion of the weight of the user through the device and away from the knee and joints of the user; and D) to provide a lower body support device which allows improved stability while employed in a kneeling position;

Further objects and advantages are to provide a lower body support device with a user chosen knee pad which may be easily replaced when said knee pad is no longer useful in the discretion of the user. Still further objects and advantages will become apparent from consideration of the ensuing description and drawings.

REFERENCE NUMERALS IN DRAWINGS

Figure 1:
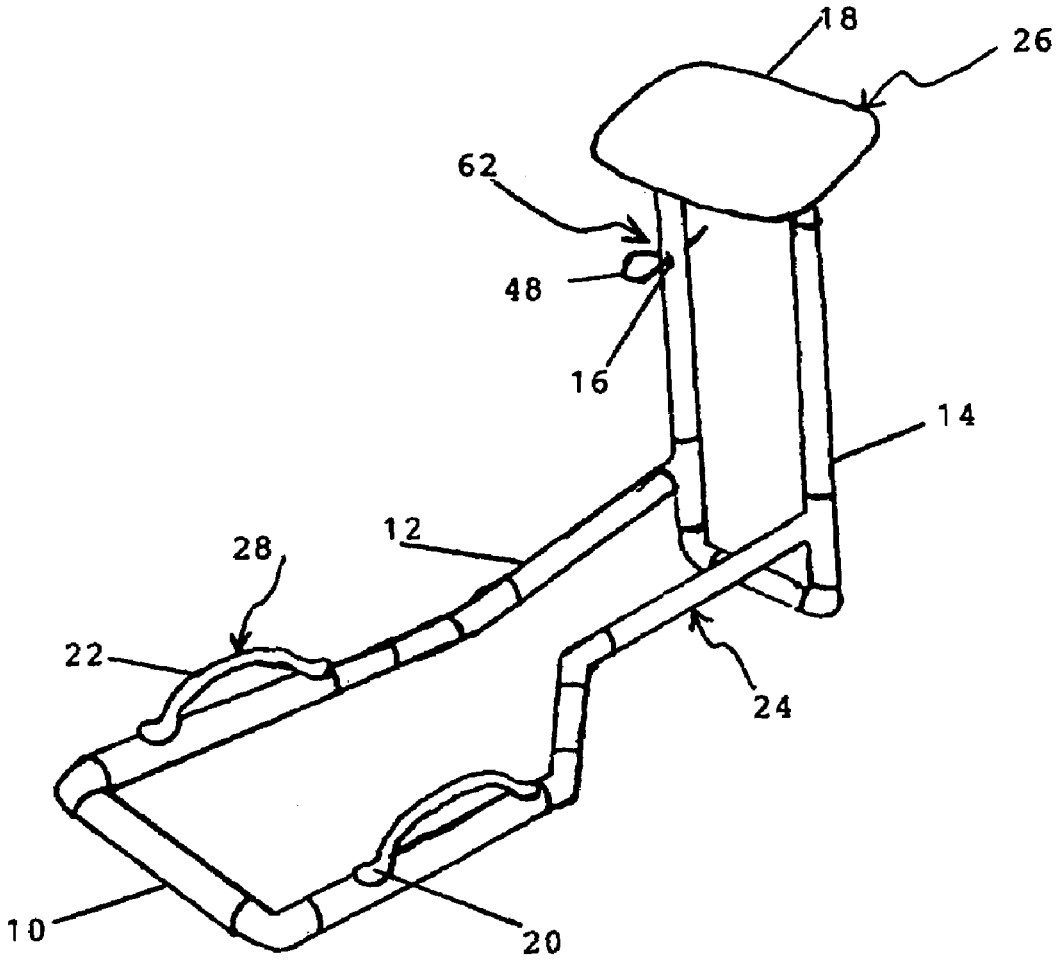
FIG. 1 is an Isometric View of the Lower Body Support Device.

10 Knee frame
12 Bend frame
14 Ankle frame
16 Ankle frame hole
18 Seat insert
20 Strap bar one
22 Strap bar two
24 Framing means
26 Seating means
28 Fastening means
30 Knee frame pads
32 Bend frame pads
34 Ankle frame pads
36 Upper seat pad
38 Lower seat pad
40 Seat rod
42 Long seat rod end
44 Long seat rod hole
46 Short seat rod end
48 Seat fastening pin
50 Board
52 Rubber feet
54 Ankle support rod
56 Knee pad
58 Knee pad straps
60 connecting means
62 Adjoining means
64 Enclosed knee frame
66 Single-rod bend frame
68 Single-rod ankle frame
70 Single-rod seat

DETAILED DESCRIPTION OF INVENTION

In its most simple configuration the lower body support device comprises three basic elements. First, there is a framing means 24 to support the leg of the user. Second there is a seating means 26 providing a region on which the user may sit. Once seated, a substantial amount of the user's body weight is transferred through the device, away from the user's leg, and onto the surface upon which the device rests. Third, there is a fastening means 28 for attaching the user to the device.

In the preferred embodiment of the invention, the framing means 24 is divided into three parts. As shown in FIG. 1, these parts are the knee frame 10, the bend frame 12, and the ankle frame 14.

Figure 2:
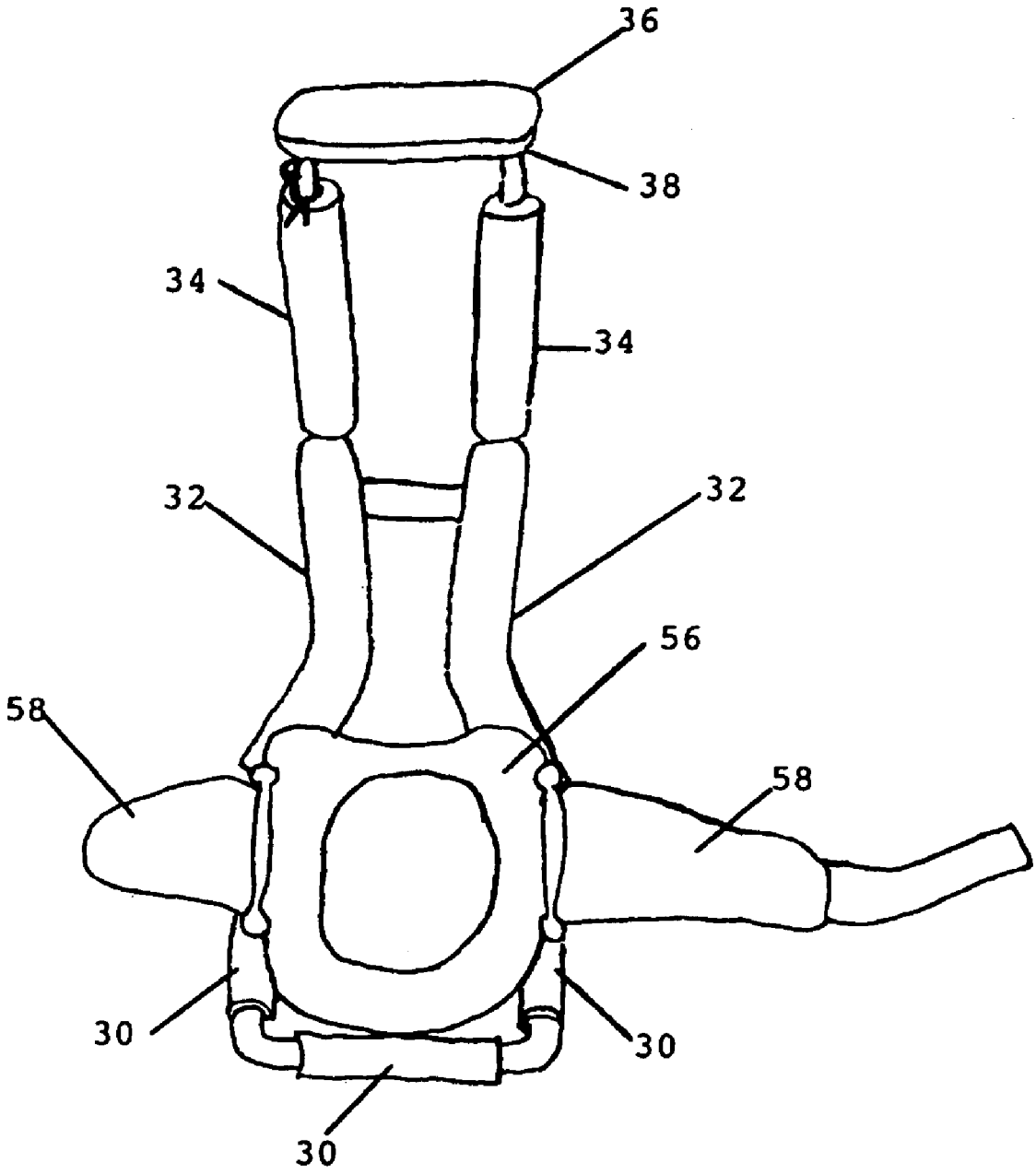
FIG. 2 is a Top-front View of the Lower Body Support Device with pads.

Knee frame 10 receives the knee of the user. Knee frame 10 is designed to accommodate both the knee of the user as well as a knee pad 56 worn by the user. The user may choose a knee pad 56 to it within the region defined by knee frame 10. Such knee pad 56 should have knee pad straps 58 and may be any of several available on the open market. As shown in FIG. 2, a typical user chosen knee pad 56 available on the open market fits within the region defined by knee frame 10, which is shown covered with knee frame pads 30. It is acceptable if part of knee pad 56 intrudes into the region defined by the bend frame 12, which is connected to knee frame 10.

Additionally, two strap bars, strap bar one 20 and strap bar two 22, are connected to the knee frame 10. Once the user dons the chosen knee pad 56 and inserts the knee of the user (with knee pas in place) within the open region of knee frame 10, the straps of the knee pad 56 are fitted through strap bar one 20 and strap bar two 22. Then, the user fastens the knee pad straps 58 behind the knee of the user, securing the knee pad 56 and the user to the device.

Bend frame 12 receives the shin of the user. As may be seen in FIG. 1, bend frame 12 connects knee frame 10 to ankle frame 14. Preferably, bend frame 12 may be covered with bend frame pads 32.

Figure 3:
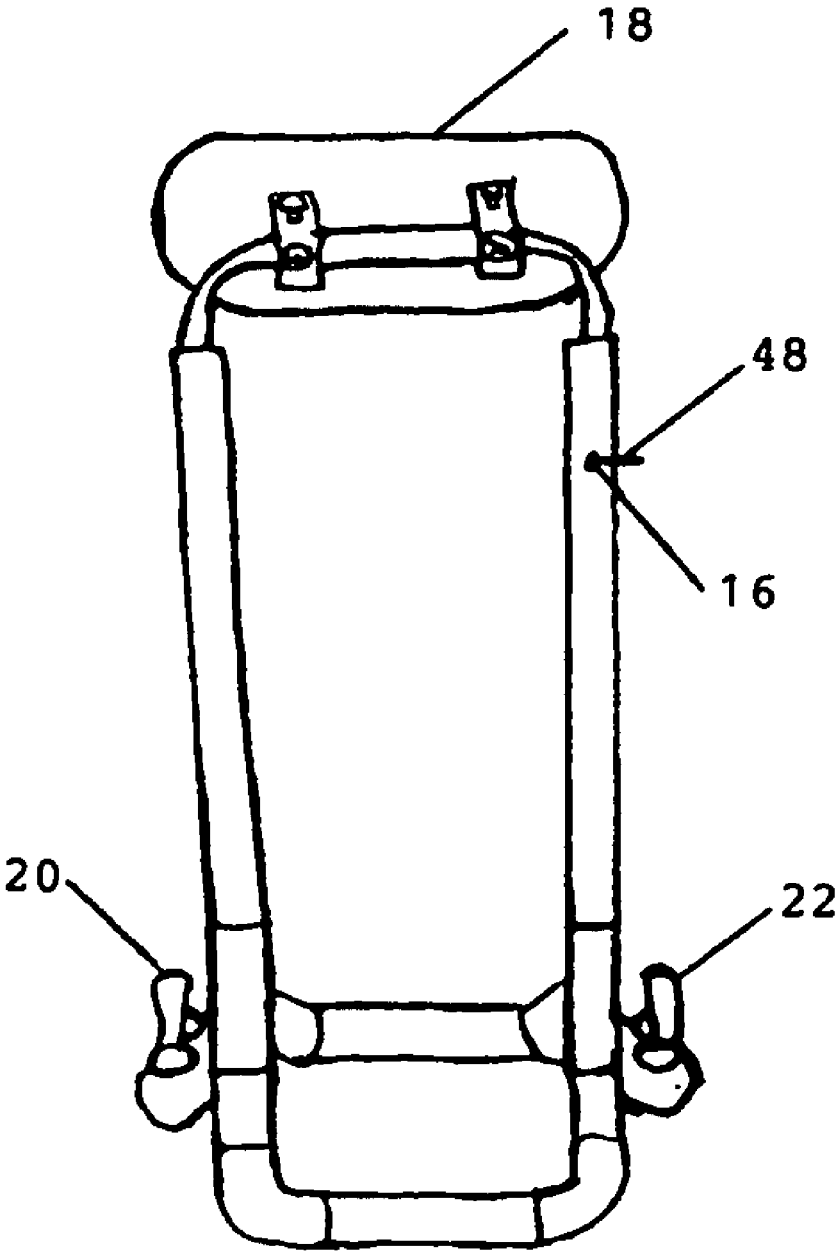
FIG. 3 is a Rear View of the Lower Body Support Device.

Ankle frame 14 receives the ankle of the user. Ankle frame 14 connects to bend frame 12. The upper portion of ankle frame 14 receives seat insert 18 by using an adjoining means 62, which is discussed in more detail below. The upper portion of ankle frame 14 comprises two hollow tubes. As may be seen in FIG. 3, both hollow tubes have an inner diameter which accepts the outer diameter of the long and short seat rod ends, 42 and 46 respectively. Preferably, ankle frame 14 may be covered with ankle frame pads 34.

Figure 4:
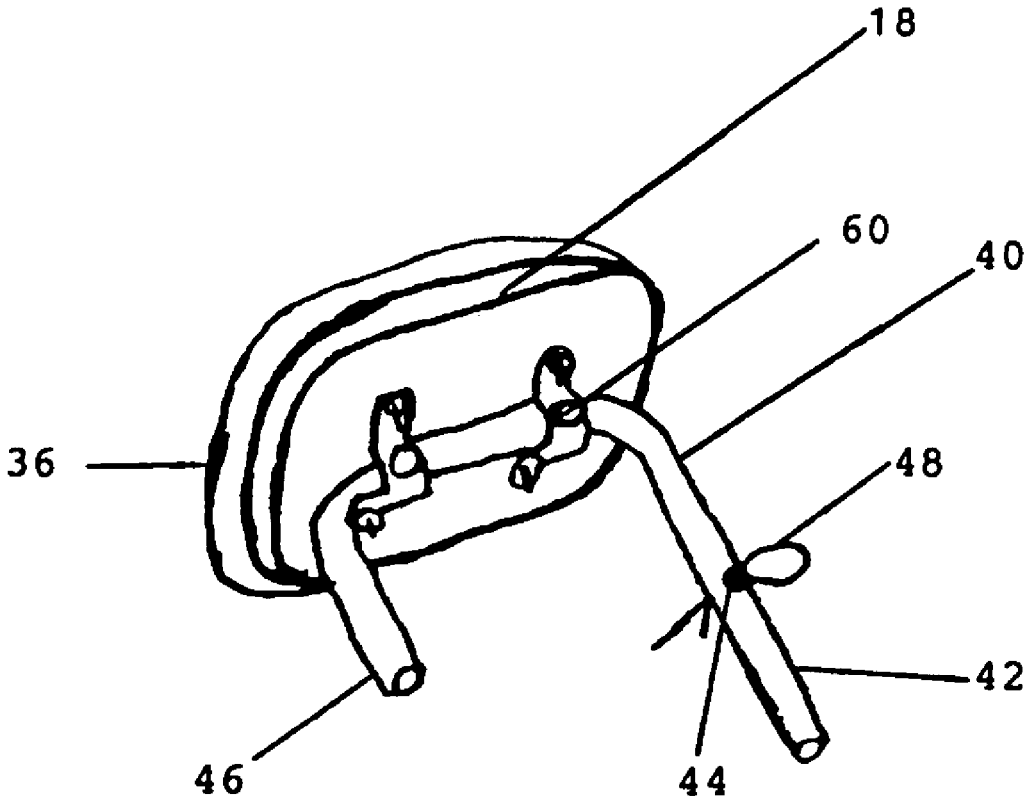
FIG. 4 is an Underside View of the Seat of the Lower Body Support Device.

Seat insert 18 is slightly inclined when placed within the hollow tubes of the ankle frame 14. Seat insert 18 includes a seat rod 40. As seen in FIG. 4, seat rod 40 is a single element fastened to seat insert 18 via a seat connecting means 60, preferably a screw, rivet, or bolt. Seat rod 40 has long and short seat rod ends, 42 and 44 respectively. To increase user comfort, seat insert 18 may be equipped with an upper seat pad 36 and a lower seat pad 38.

In the preferred embodiment of the adjoining means 62, one of the hollow tubes of the ankle frame 14 includes an ankle frame hole 16 for accepting a seat fastening pin 48, which secures the seat insert 18 to the ankle frame 14. Correspondingly, the long seat rod end 42 also has a long seat rod hole 44 for accepting the seat fastening pin 48. Once the user's leg is fitted onto the device, seat insert 18 is placed within the hollow tubes of ankle frame 14. Then, seat fastening pin 48 is inserted through the ankle frame hole 16 and the long seat rod hole 44, securing the seat insert 18 to the ankle frame 14.

ALTERNATIVE EMBODIMENTS

While the above description contains many specificities, these should not be construed as limitations on the scope of the invention, but rather as an exemplification of one preferred embodiment thereof. Many variations are possible and some are as follows.

First, the materials used in the lower body support device can be wood, metal, plastic, composite, or other materials commonly used in the knee pad, body armor, or similar industries. Different materials allow differing strengths and weaknesses which would be used to match consumer preferences, needs, and budget restraints.

Figure 5:
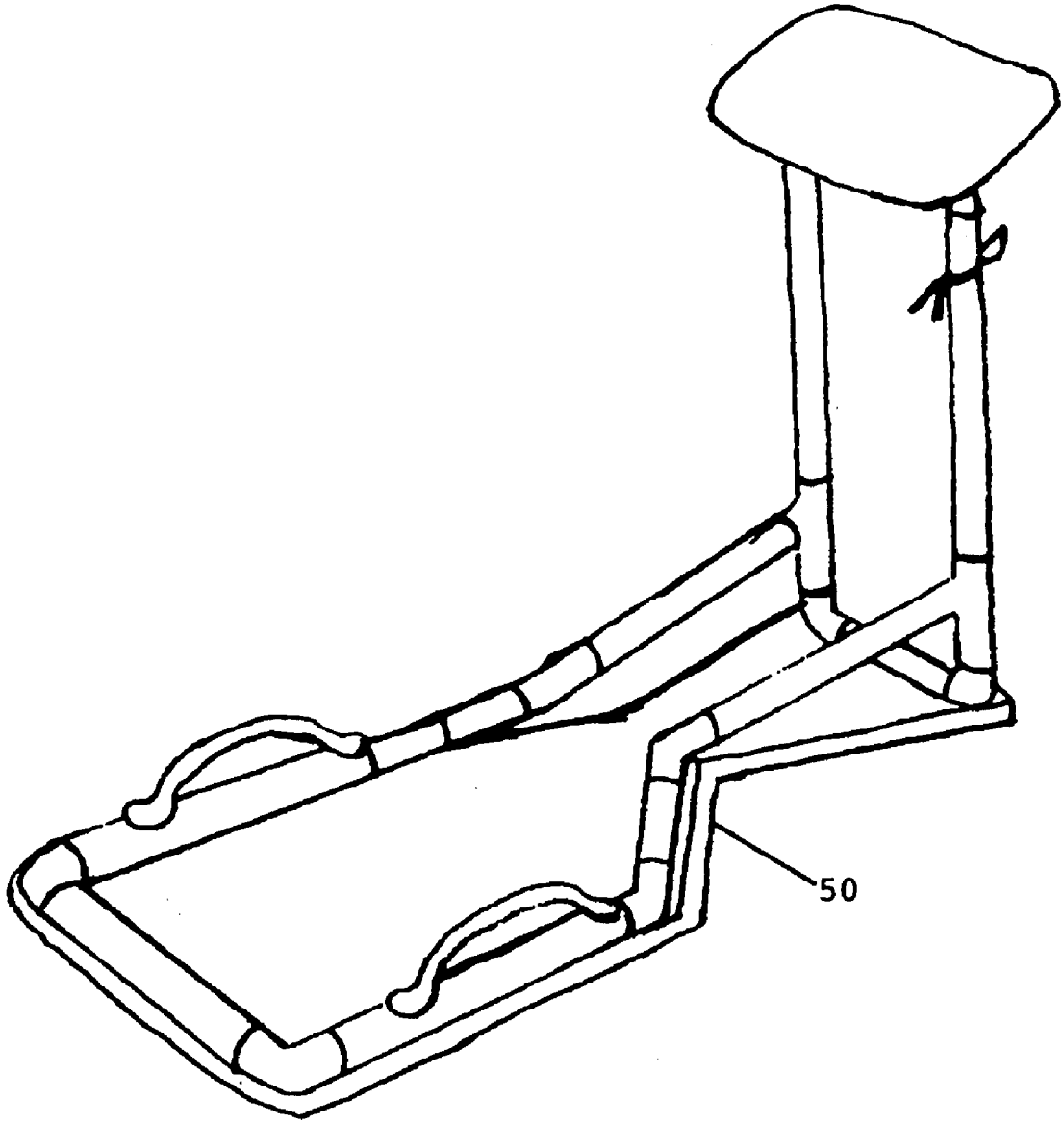
FIG. 5 is an Alternative Embodiment featuring a Board.

Second, the device may be equipped with a board 50. As shown in FIG. 5, board 50 is connected to the device along the bottom of the framing means. Use of the board 50 would be useful for masons or similar users working on hard or scratch resistant surfaces.

Figure 6A:
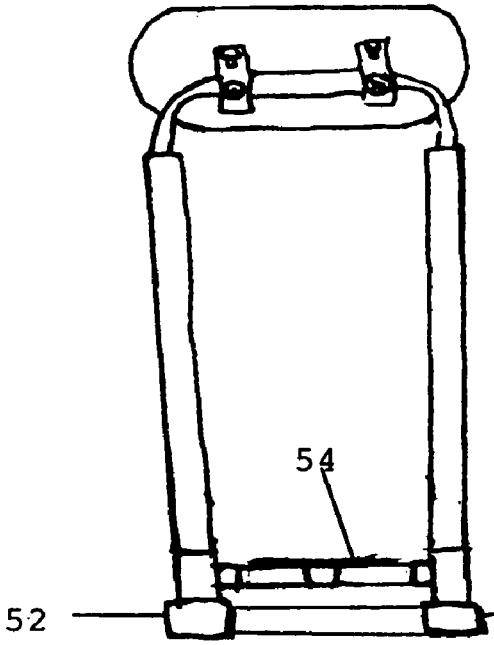
FIG. 6A is a Rear View of the Alternative Embodiment of the Ankle Frame.
Figure 6:
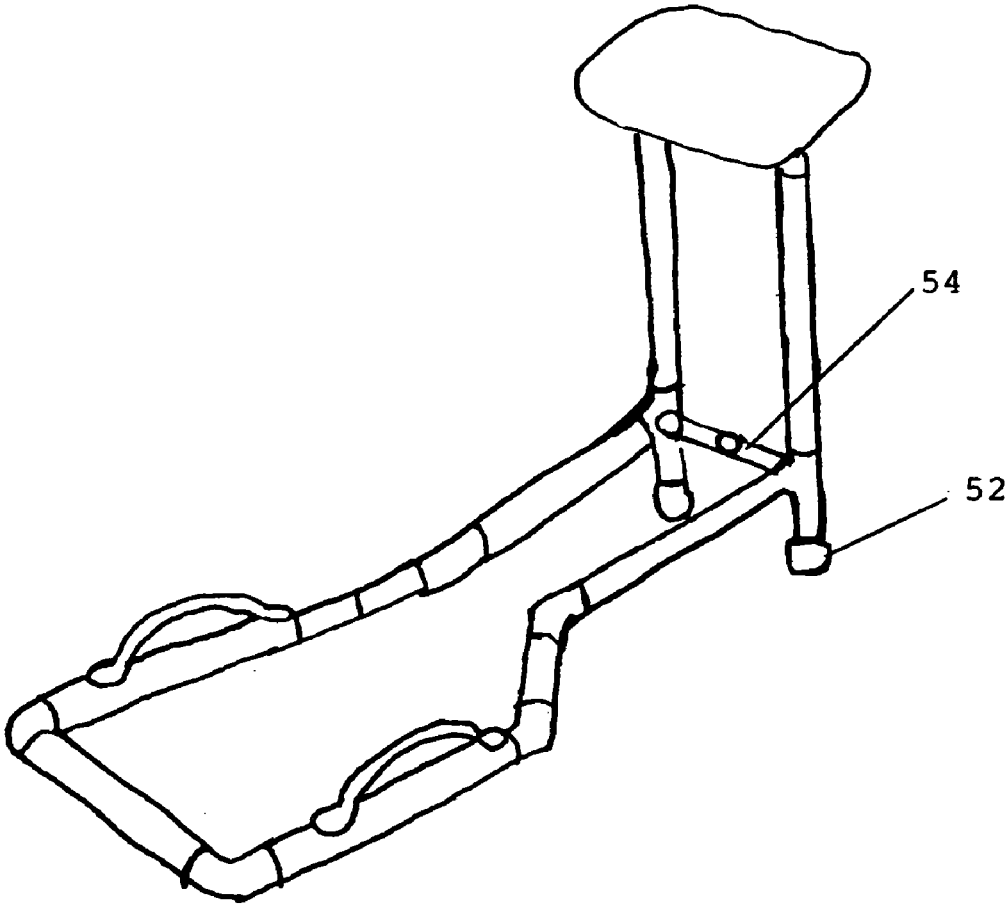
FIG. 6 is an Isometric view of an Alternative Embodiment of the Ankle Frame.

Third, the ankle frame 14 may be configured as shown in FIGS. 6 and 6A. In this embodiment, the lower end of the ankle frame 14 comprises two vertical tubes or rods capped with rubber feet 52. Additionally, an ankle support rod 54 is inserted between the two vertical tubes or rods. This embodiment is best used when the user would prefer to use a knee pad with an attached shin pad or a shin pad independent of a knee pad. Additionally, the ankle support rod 54 may be fitted with an ankle fastening means for securing the user's ankle, padding, shin pad, or combination knee pad and shin pad. In any case, the ankle support rod 54 would provide support at the location of contact with it.

Figure 7:
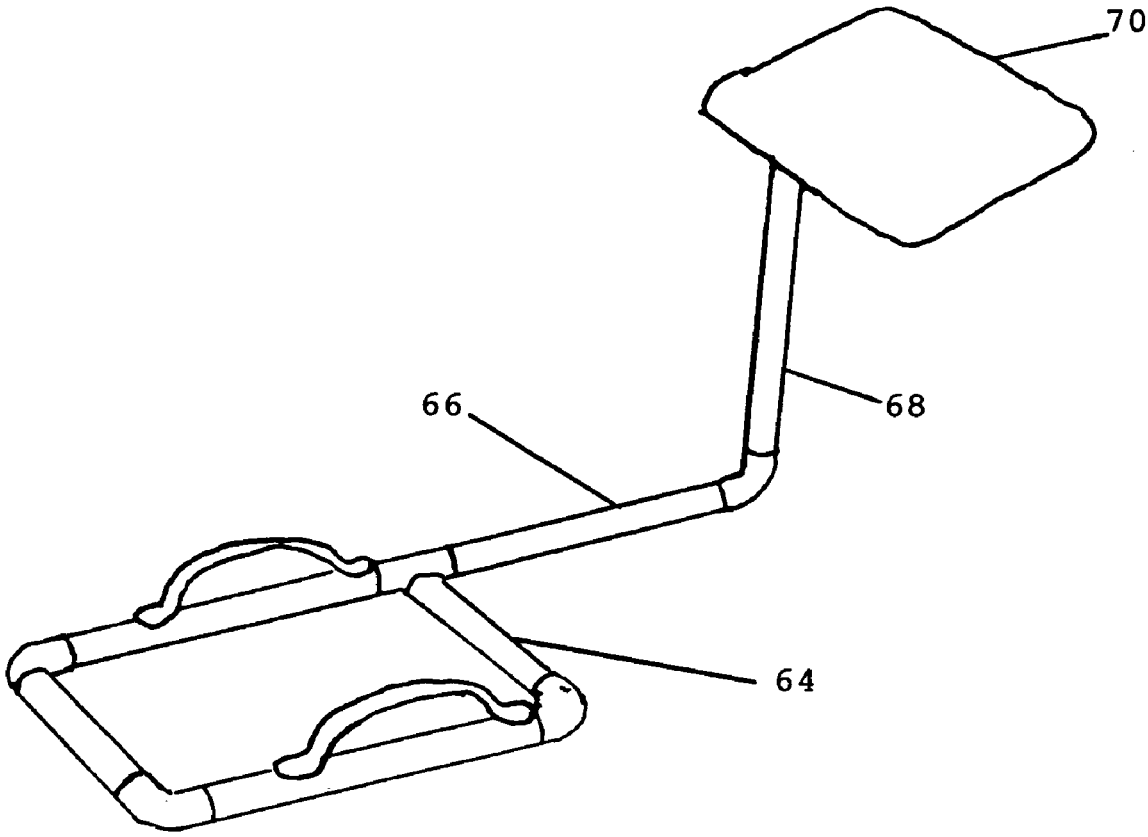
FIG. 7 is an Isometric view of the P-Shaped Alternative Embodiment.

Fourth, the device may be configured in a P-shape. As shown in FIG. 7, the P-shaped embodiment comprises an enclosed knee frame 64, a single-rod bend frame 66, a single-rod ankle frame 68, and a single-rod seat 70.

Fifth, the seating means 26 may be attached to the framing means 24 in many ways common in the prior art. Such ways of attachment, generally referred to as adjoining means 62, include, but are not limited to hinges, caps, clips, clamps, straps, screws, and latches.

Figure 8:
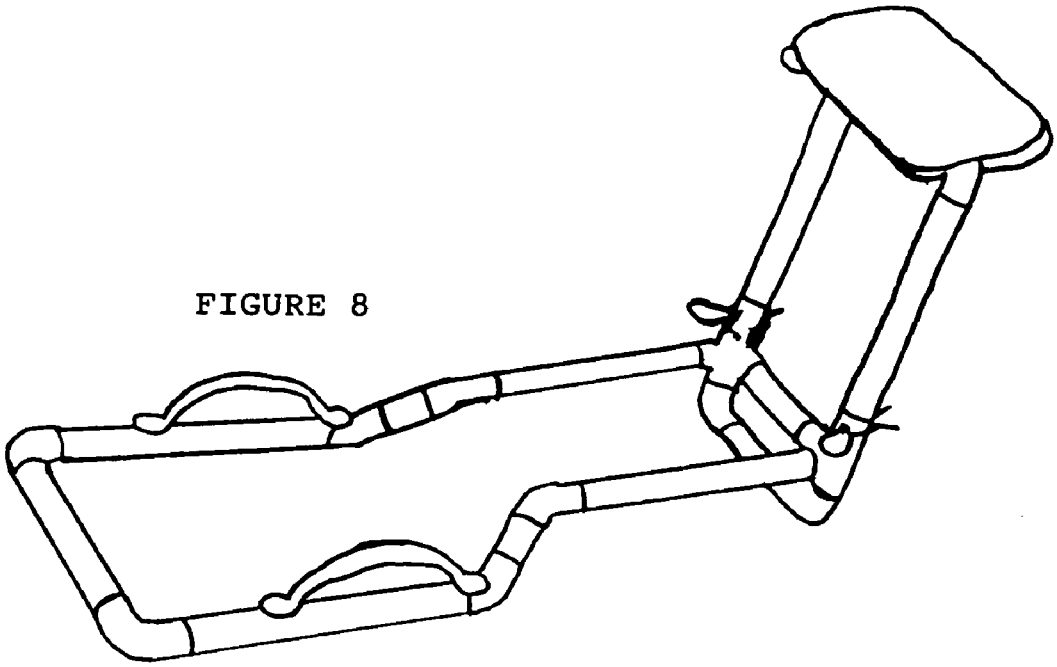
FIG. 8 is an Isometric view of an Alternative Embodiment of the Ankle Frame with removable vertical rods.
Figure 8A:
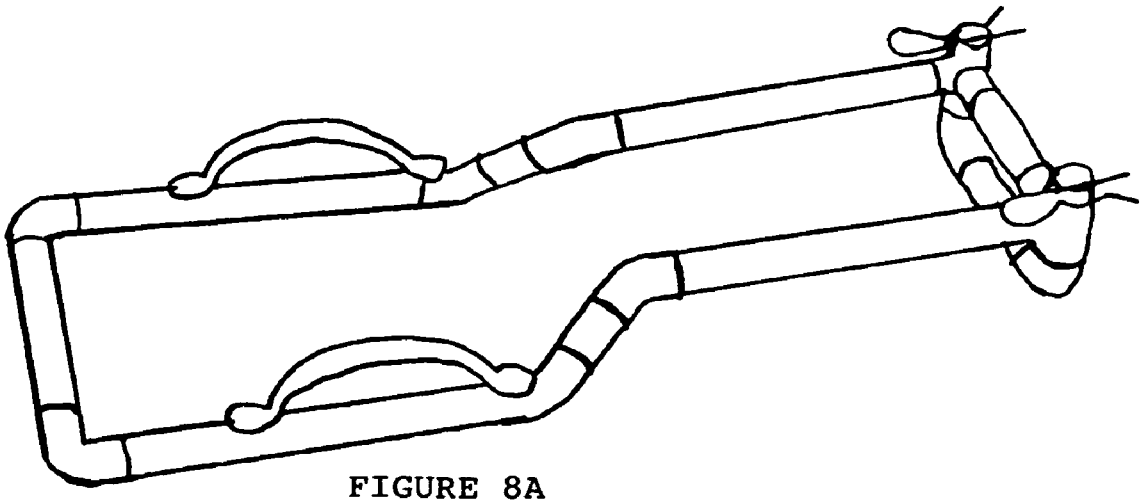
FIG. 8A is an Isometric view of an Alternative Embodiment of the Ankle Frame with vertical rods removed.
Figure 9:
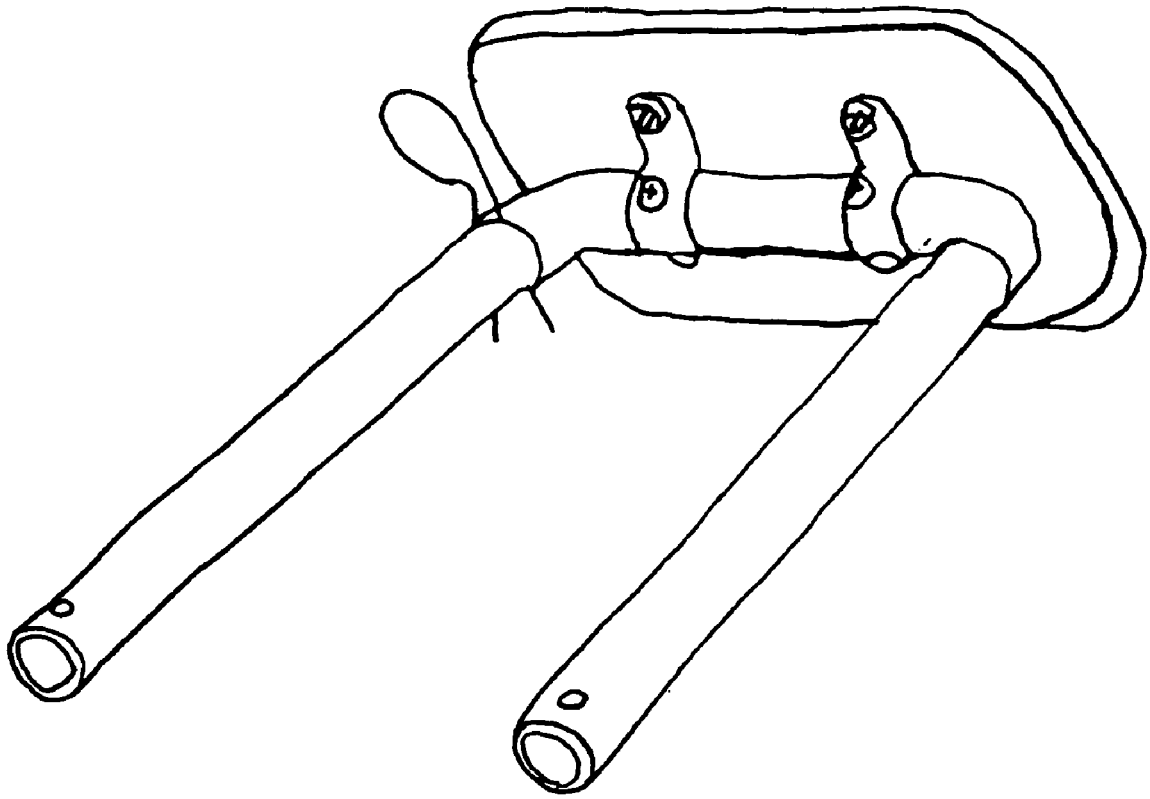
FIG. 9 is an Isometric view of an Alternative Embodiment of the Seat insert corresponding to the Ankle Frame with removable vertical rods.

Sixth, as shown in FIGS. 8 and 8A, the ankle frame may be configured to be removable from the bend frame. In FIG. 8, the ankle frame is shown with additional holes and pins. When these pins are removed, the embodiment of the device is that as shown in FIG. 8A. The seat insert which corresponds to this embodiment is illustrated in FIG. 9.

The embodiments above-discussed are to be considered illustrative and not restrictive. Many more embodiments may be configured using combinations of the embodiments above-discussed. Thus, the scope of the invention should be determined by the appended claims and their legal equivalents.

CONCLUSIONS, RAMIFICATIONS, AND SCOPE

The utility of lower body support device is apparent. In the preferred embodiment, the device provides improved lower body support, mobility, and stability in a less complex configuration.

Lower body support is obtained via the framing means and the seating means. When a user sits upon the seat, the device transfers a significant portion of the weight of the user to the surface upon which the device rests via the frame.

The user may use the device in a kneeling position, a seated-kneeling position, or while walking. Thus user mobility is improved.

The device provides exceptional stability, resisting side-to-side movement and corresponding rotation. That is, the shape of the knee frame and the bottom portion of the ankle frame add stability to the device.

Another benefit of the invention is its use of knee pads for sale on the open market. As such the user may choose from a large number of existing, readily available knee pads. Moreover, once a user chosen knee pad wears out, the user may simply replace the knee pad without having to replace the entire device.

The above-discussion is to be considered illustrative and not restrictive. Thus, the scope of the invention should be determined by the appended claims and their legal equivalents.

I claim:

1. A lower body support device comprising, in combination:

a. a framing means for supporting the weight of the user, b. a seating means, connectable to the framing means, for providing a place on which the user may sit, c. a fastening means, connected to said framing means, for attaching the leg of the user to the device via a user chosen knee pad equipped with straps, comprising:

i. a strap bar one, and ii. a strap bar two whereby a user positions the leg of the user onto the framing means with the knee of the user atop a user chosen knee pad, passes one of the straps attached to said user chosen knee pad through strap bar one, passes the other strap attached to said user chosen knee pad through strap bar two, fastens the straps of the user chosen knee pad behind the knee of the user, thereby securing the user to the device, and then the user connects the seating means into or onto the framing means.

2. The device of claim 1, wherein said framing means comprises:

a. a knee frame, b. a bend frame, and c. an ankle frame, whereby the knee of the user fits within the region defined by the knee frame, the shin of the user fits within the region defined by the bend frame section, and the ankle of the user fits within the region defined by the ankle frame.

3. The device of claim 1, wherein said seating means comprises:

a. a seat insert fastened to, b. a seat rod; with a long seat rod end, which includes a long seat rod hole, and short seat rod end; and c. a seat fastening pin whereby said seat insert is fastened to the framing means via the seat fastening pin fitted through said long seat rod hole and a corresponding hole in the framing means.

4. The device of claim 1, wherein a. said framing means comprises:

i. a knee frame, ii. a bend frame, and iii. an ankle frame with an ankle frame hole, b. said seating means comprises:

i. a seat insert fastened to, ii. a seat rod; with a long seat rod end, which includes a long seat rod hole, and short seat rod end; and iii. a seat fastening pin, and c. said fastening means comprises:

i. a strap bar one and ii. a strap bar two whereby the user assumes a position with the knee of the user within the region defined by the knee frame and atop a user chosen knee pad, the shin of the user within the region defined by the bend frame, and the ankle of the user within the region defined by the ankle frame; one of the straps attached to the user chosen knee pad is fed through strap bar one, the other strap attached to the user chosen knee pad is fed through strap bar two, and then the straps of the user chosen knee pad are secured behind the knee of the user, securing the user to the device; then the seat insert is inserted into the ankle frame and secured thereto via the seat fastening pin fitted through said long seat rod hole in said long seat rod end and the corresponding ankle frame hole.

5. A lower body support device comprising, a. a knee frame of sufficient size to accommodate a human knee wearing a user chosen knee pad;

b. a bend frame of sufficient size to accommodate a human shin;

c. an ankle frame of sufficient size to accommodate a human ankle;

d. a seat insert, e. a seat rod,
f. a strap bar one fastened to said knee frame,
g. a strap bar two fastened to said knee frame,
h. a seat connecting means for attaching said seat insert to said seat rod, and
i. an adjoining means for attaching said seat insert together with said seat rod to said ankle frame, whereby the user assumes a position with the knee of the user within the region defined by the knee frame and atop a user chosen knee pad, the shin of the user within the region defined by the bend frame, and the ankle of the user within the region defined by the ankle frame; one of the straps attached to the user chosen knee pad is fed through strap bar one, the other strap attached to the user chosen knee pad is fed through strap bar two, and then the straps of the user chosen knee pad are secured behind the knee of the user, securing the user to the device; then the seat insert is attached to the ankle frame by using the said ankle framing means.

6. A lower body support device comprising,
a. a knee frame of sufficient size to accommodate a human knee wearing a user chosen knee pad;
b. a bend frame of sufficient size to accommodate a human shin;
c. an ankle frame of sufficient size to accommodate a human ankle;
d. an ankle frame hole in said ankle frame;
e. a seat insert,
f. a seat rod; with a long seat rod end, which includes a long seat rod hole, and with a short seat rod end; fastened to said seat insert;
g. a seat fastening pin,
h. a strap bar one fastened to said knee frame, and
i. a strap bar two fastened to said knee frame, whereby the user assumes a position with the knee of the user within the region defined by the knee frame and atop a user chosen knee pad, the shin of the user within the region defined by the bend frame, and the ankle of the user within the region defined by the ankle frame; one of the straps attached to the user chosen knee pad is fed through strap bar one, the other strap attached to the user chosen knee pad is fed through strap bar two, and then the straps of the user chosen knee pad are secured behind the knee of the user, securing the user to the device; then the seat insert is inserted into the ankle frame and secured thereto via the seat fastening pin fitted through said long seat rod hole in said long seat rod end and the corresponding ankle frame hole.

7. A method for attaching the leg of a person to a lower body support device, comprising the steps of:
a. providing a framing means for supporting the weight of the user
b. providing a seating means, connectable to the framing means, for allowing a place on which the user may sit,
c. providing a fastening means, connected to said framing means, for attaching the leg of the user to the device via a user chosen knee pad equipped with straps, comprising:
i. a strap bar one, and
ii. a strap bar two whereby a user positions the leg of the user onto the framing means with the knee of the user atop a user chosen knee pad, attaches the leg of the user to the device by threading the straps of the user chosen knee pad through strap bar one and strap bar two, adheres the straps of the user chosen knee pad behind the knee of the user, and then connects the seating means into or onto the framing means.

8. The method of claim 7, wherein said framing means comprises:
a. a knee frame,
b. a bend frame, and
c. an ankle frame, whereby the knee of the user fits within the region defined by the knee frame, the shin of the user fits within the region defined by the bend frame section, and the ankle of the user fits within the region defined by the ankle frame.

9. The method of claim 7, wherein said framing means is fitted with a hole and wherein said seating means comprises:
a. a seat insert fastened to,
b. a seat rod; with a long seat rod end, which includes a long seat rod hole, and short seat rod end; and
c. a seat fastening pin whereby said seat insert is fastened to the framing means via the seat fastening pin fitted through said long seat rod hole and a corresponding hole in the framing means.

10. The method of claim 7, wherein:
a. said framing means comprises:
i. a knee frame,
ii. a bend frame, and
iii. an ankle frame with an ankle frame hole,
b. said seating means comprises:
i. a seat insert fastened to,
ii. a seat rod; with a long seat rod end, which includes a long seat rod hole, and short seat rod end; and
iii. a seat fastening pin, and
c. said fastening means comprises:
i. a strap bar one and
ii. a strap bar two whereby the user assumes a position with the knee of the user within the region defined by the knee frame and atop a user chosen knee pad, the shin of the user within the region defined by the bend frame, and the ankle of the user within the region defined by the ankle frame; one of the straps attached to the user chosen knee pad is fed through strap bar one, the other strap attached to the user chosen knee pad is fed through strap bar two, and then the straps of the user chosen knee pad are secured behind the knee of the user, securing the user to the device; then the seat insert is inserted into the ankle frame and secured thereto via the seat fastening pin fitted through said long seat rod hole in said long seat rod end and the corresponding ankle frame hole.

* * * * *